US011780114B2

(12) United States Patent
Panis

(10) Patent No.: US 11,780,114 B2
(45) Date of Patent: Oct. 10, 2023

(54) DEVICE FOR PRESSING A NON-HARDENED CONCRETE COMPOSITION AND METHOD FOR THE MANUFACTURE OF CONCRETE ARTICLES

(71) Applicant: EBEMA, NAAMLOZE VENNOOTSCHAP, Zutendaal (BE)

(72) Inventor: Bert Panis, Wommelgem (BE)

(73) Assignee: EBEMA, NAAMLOZE VENNOOTSCHAP, Zutendaal (BE)

( * ) Notice: Subject to any disclaimer, the term of this patent is extended or adjusted under 35 U.S.C. 154(b) by 379 days.

(21) Appl. No.: 16/766,115

(22) PCT Filed: Nov. 22, 2018

(86) PCT No.: PCT/IB2018/059225
§ 371 (c)(1),
(2) Date: May 21, 2020

(87) PCT Pub. No.: WO2019/102393
PCT Pub. Date: May 31, 2019

(65) Prior Publication Data

US 2020/0361117 A1 Nov. 19, 2020

(30) Foreign Application Priority Data

Nov. 23, 2017 (EP) ..... 17203215

(51) Int. Cl.
*B28B 3/02* (2006.01)
*B28B 3/06* (2006.01)
(Continued)

(52) U.S. Cl.
CPC ..... *B28B 3/028* (2013.01); *B28B 3/06* (2013.01); *B28B 13/023* (2013.01);
(Continued)

(58) Field of Classification Search
CPC ..... B28B 1/04; B28B 1/087; B28B 1/267; B28B 3/00; B28B 3/02; B28B 3/021;
(Continued)

(56) References Cited

U.S. PATENT DOCUMENTS 2,965,948 A * 12/1960 Albertc ..... B28B 3/022 425/153
3,153,262 A * 10/1964 Steketee ..... B29C 43/50 425/444
(Continued)

FOREIGN PATENT DOCUMENTS

DE 7210653 9/1974
DE 33 44 519 6/1985
(Continued)

OTHER PUBLICATIONS

Machine Englsih translation of Sakurai et al. (JP-2010126407-A); (2010); Retrieved from Espace.net (https://worldwide.espacenet.com/patent/search/family/042327043/publication/JP2010126407A?q=pn%3DJP2010126407A) (Year: 2010).*
(Continued)

*Primary Examiner* — Francisco W Tschen
*Assistant Examiner* — Edgaredmanuel Troche
(74) *Attorney, Agent, or Firm* — NIXON & VANDERHYE

(57) ABSTRACT

Device for pressing a non-hardened concrete composition into a desired form includes an upper plate with first cavities running through the upper plate, a moulding plate with one or more second cavities whereby the upper plate is located directly above the moulding plate, a bottom plate located under the moulding plate whereby the bottom plate closes the one or more second cavities on the bottom, whereby the upper plate and the moulding plate can move horizontally in relation to each other between a first position in which the
(Continued)

one or more first cavities are directly and exactly above the one or more second cavities and a second position in which the one or more first cavities are not above the one or more second cavities, wherein the thickness of the upper plate and not the thickness of the moulding plate is decisive for the thickness of the final article.

16 Claims, 5 Drawing Sheets

(51) Int. Cl.

| | |
|---|---|
| ***B28B 13/02*** | (2006.01) |
| ***B30B 15/30*** | (2006.01) |
| ***B30B 15/32*** | (2006.01) |
| ***B28B 15/00*** | (2006.01) |

(52) U.S. Cl.
CPC ..... *B28B 15/005* (2013.01); *B30B 15/304* (2013.01); *B30B 15/32* (2013.01)

(58) Field of Classification Search
CPC ..... B28B 3/027; B28B 3/028; B28B 3/06; B28B 5/00; B28B 7/0038; B28B 7/0097; B28B 13/023; B28B 13/06; B28B 15/005; B30B 15/304
See application file for complete search history.

(56) References Cited

U.S. PATENT DOCUMENTS

| | | | | |
|---|---|---|---|---|
| 3,499,069 | A | 3/1970 | Seigle | |
| 4,335,065 | A * | 6/1982 | Ando | B28B 7/10 425/85 |
| 6,244,069 | B1 * | 6/2001 | Hyde, Jr. | C01B 32/50 62/341 |
| 2010/0254847 | A1 * | 10/2010 | Rhee | B28B 3/027 419/38 |
| 2011/0304068 | A1 * | 12/2011 | Ness | B28B 13/0295 264/118 |
| 2012/0097054 | A1 * | 4/2012 | Young | B30B 15/32 100/215 |
| 2014/0048964 | A1 * | 2/2014 | LaCroix | B28B 1/29 264/37.19 |
| 2014/0084507 | A1 * | 3/2014 | Young | B30B 11/025 264/109 |

FOREIGN PATENT DOCUMENTS

| | | |
|---|---|---|
| FR | 2624485 | 6/1989 |
| JP | S51-100106 | 9/1976 |
| JP | S61 171411 | 8/1986 |
| JP | 2010-126407 | 6/2010 |

OTHER PUBLICATIONS

International Search Report, PCT/IB2018/059225, dated Feb. 18, 2019.
Written Opinion, PCT/IB/2018/059225, dated Feb. 18, 2019.

* cited by examiner

DEVICE FOR PRESSING A NON-HARDENED CONCRETE COMPOSITION AND METHOD FOR THE MANUFACTURE OF CONCRETE ARTICLES

BACKGROUND OF THE INVENTION

Field of the Invention

The present invention relates to a device for pressing a non-hardened concrete composition and a method for the manufacture of concrete articles More specifically, the invention is meant to be able to manufacture thin concrete articles by pressing a non-hardened concrete composition.

This relates to, for example, façade stone strips, i.e. thin strips of formed concrete that look like façade stone.

DESCRIPTION OF THE RELATED ART

It is known that it is financially attractive to manufacture concrete articles by pressing a non-hardened concrete composition, because form stable objects are quickly formed which can then, outside the used mould, harden.

However, this method cannot be applied on an industrial scale for thin products. The reason for this is that traditional techniques require the moulds to be filled completely with a non-hardened concrete composition.

To manufacture a thin object the moulding plate would have to be made very thin. However, such a thin moulding plate is not strong enough and would quickly deform by bending and even break.

With such a thin plate there is also no possibility to provide a beveled edge at the top that is long enough to sufficiently guide the stamps. This would cause considerable wear and tear of the stamps and the moulding plate.

There is also no room at the bottom of the moulding plate to remove material between the bottoms of the cavities in the moulding plate and to only leave material of the moulding plate around the bottoms of the cavities.

In itself this is desirable because a bottom plate is used which may be covered with stones and/or concrete, whereby the bottom plate without this measure would not be able to fit well against the moulding plate because of the aforementioned stones/concrete.

However, with a thin moulding plate this measure cannot be applied, because then the thickness, and therefore the strength of the moulding plate would be even less.

SUMMARY OF THE INVENTION

The purpose of the present invention is to provide a solution for the aforementioned and other disadvantages, by providing a device for pressing a non-hardened concrete composition into a desired form, whereby the device comprises an upper plate with one or more first cavities that run through the upper plate, a moulding plate with one or more second cavities, that have the desired form and at the top are open and whereby the upper plate is located directly and joining, above the moulding plate, a bottom plate located under the moulding plate whereby the bottom plate closes the one or more second cavities on the bottom, whereby the upper plate and the moulding plate can move horizontally in relation to each other between a first position in which the one or more first cavities are directly and exactly above the one or more second cavities, such that a non-hardened concrete composition can fall from a first cavity into a second cavity and a second position in which the one or more first cavities are not above the one or more second cavities, but only above plate material of the moulding plate that is located next to those one or more second cavities, such that the one or more first cavities are closed at the bottom.

The thickness of the upper plate, not the thickness of the moulding plate such as with the traditional techniques, is now decisive for the quantity of used concrete composition and therefore for the thickness of the final article.

Consequently, the moulding plate can be made sufficiently thick to have sufficient strength and to remove material from the bottom such that the contact surface with a bottom plate is restricted.

Consequently, this device also allows thin concrete articles to be manufactured by means of pressing in a financially favourable way.

Preferably the device is provided with one or more stamps that can move vertically to press the non-hardened concrete composition, whereby the stamps are located above the one or more second cavities.

Preferably the upper plate can be moved horizontally and the moulding plate cannot be moved horizontally, such that the alignment of the second cavities with the stamps is not in danger.

In a preferred embodiment the moulding plate can move vertically between a lowest position, whereby the moulding plate closes the one or more second cavities at the bottom, and a highest position, whereby the non-hardened concrete articles are removed from the second cavities.

Preferably the upper plate and the moulding plate are installed to move vertically together.

Consequently, by positioning the stamps and lifting the moulding plate, the pressed articles can be removed from the moulding plate.

To this end, the device is preferably provided with a bottom plate, preferably a wooden plate, located under the moulding plate and which, when the moulding plate is in its lowest setting, closes the one or more second cavities at the bottom.

The bottom plate should be interpreted as any support that closes the one or more second cavities of the moulding plate at the bottom.

In an equivalent embodiment of a device according to the invention, the upper plate and the moulding plate do not move vertically to close of the second cavities at the bottom, but the bottom plate moves upwards against the bottom of the moulding plate to close of the cavities.

The bottom plate can then, with the pressed articles, after removing the pressed pieces from the moulding plate, be removed from under the moulding plate and replaced by another bottom plate, such that a next batch of pressed articles can be made quickly.

In one embodiment the bottom plate can be a continuous support that moves horizontally, such as an assembly line, when removing the articles.

In another preferred variant, the moulding plate has upstanding edges at the bottom around the one or more second cavities, whereby the upstanding edges form a part of the wall of the one or more second cavities.

On the bottom of the second cavities the moulding plate is provided with upstanding edges such that recesses are formed between the second cavities on the bottom of the moulding plate.

These upstanding edges then rest on the bottom plate, such that the rest of the moulding plate is free of the bottom plate such that there is less risk that stones, concrete residue and other imperfections on the bottom plate interfere with a good placement of the moulding plate on the bottom plate.

Preferably, the one or more first cavities are wider at the top than at their bottom, whereby seen from the bottom to the top there is no step-wise broadening in one or more first cavities. In this way the one or more first cavities, or at least their top, form an inlet section to guide the stamps.

The invention also relates to a method to manufacture one or more concrete articles, whereby in a first step a non-hardened concrete composition is put into one or more first cavities, whereby the one or more first cavities are applied in an upper plate and whereby the one or more first cavities on the bottom are closed by a moulding plate, whereby the thickness of the upper plate and not the thickness of the moulding plate is decisive for the thickness of the final article, whereby in a second step the upper plate and the moulding plate are moved horizontally in relation to each other until the one or more first cavities are exactly above one or more second cavities in the moulding plate such that the non-hardened concrete composition falls into the one or more second cavities, whereby a bottom plate located under the moulding plate closes the one or more second cavities on the bottom, whereby in a third step the non-hardened concrete composition is pressed into the one or more second cavities.

This method is preferably applied in a device as described above.

In a preferred embodiment of a method according to the invention in the first step the first cavities are filled to the top with a non-hardened concrete composition.

In yet a preferred embodiment of a method according to the invention after the third step the pressed non-hardened concrete composition is removed from the one or more second cavities.

In another preferred embodiment of a method according to the invention the upper plate and the moulding plate are lifted while the stamps do not move.

In an alternative embodiment of a method according to the invention, to remove the articles from the second cavities, the bottom plate moves downwards and optionally the stamps move downwards to push the articles through the second cavities. In this case, the moulding plate and the upper plate remain in position.

In a further preferred embodiment of a method according to the invention the stamps are moved up again and the non-hardened concrete articles are free on the bottom plate.

The method allows the manufacture of thin concrete articles by means of pressing. This was not possible with previously known methods.

BRIEF DESCRIPTION OF THE DRAWINGS

With the intention of better showing the characteristics of the invention, a schematic embodiment of a device according to the invention is described hereinafter by way of an example without any limiting nature, with reference to the accompanying drawings, wherein.

DESCRIPTION OF THE PREFERRED EMBODIMENTS

Figure 1:
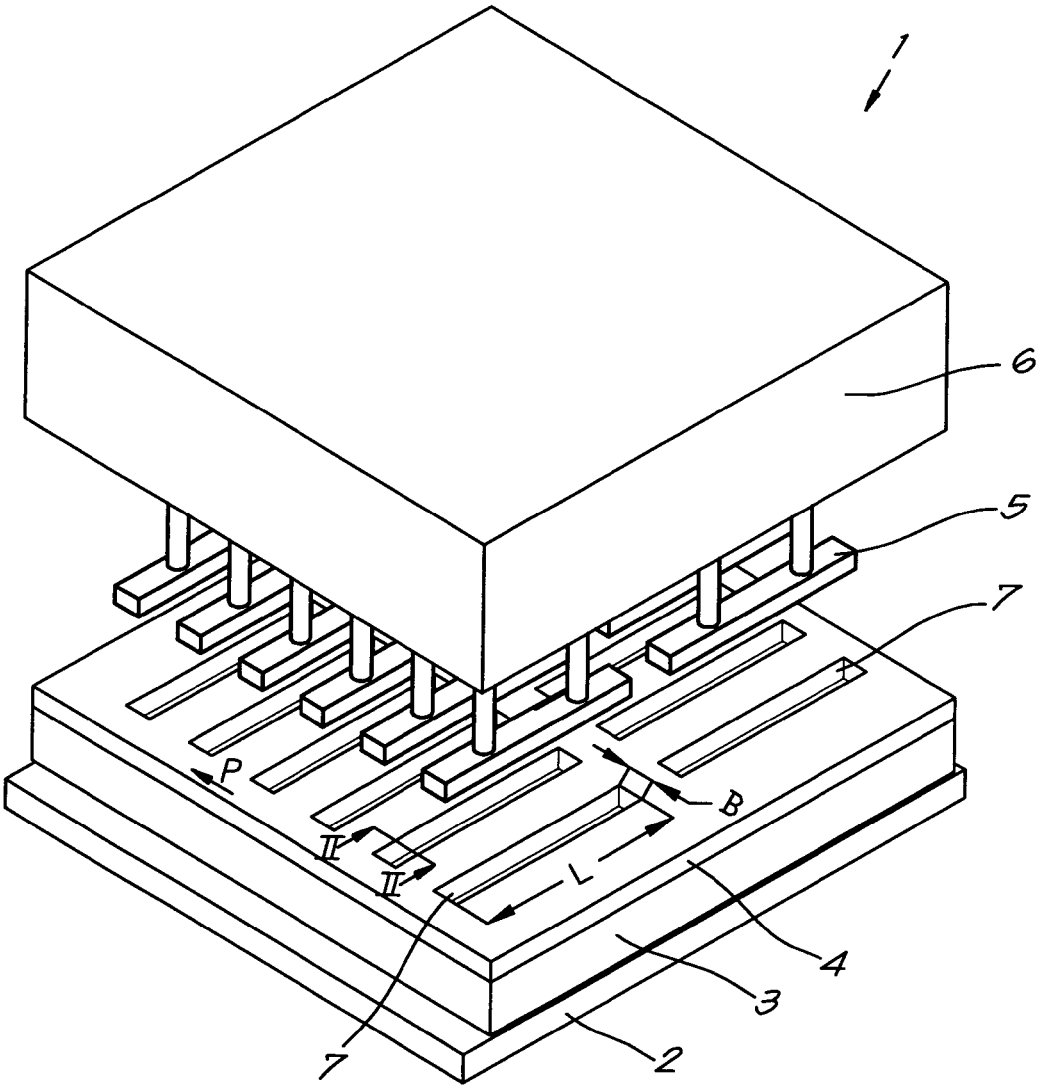
FIG. 1 schematically shows a perspective view of a device according to the invention.

The device 1 to manufacture concrete articles shown in the figures chiefly consists of a wooden bottom plate 2, a moulding plate 3 located above it, an upper plate 4 located above the moulding plate, and a set of stamps 5 with a drive 6 to allow the stamps 5 to move vertically.

The upper plate 4 is installed to move horizontally in the direction indicated by arrow P and back.

Figure 2:
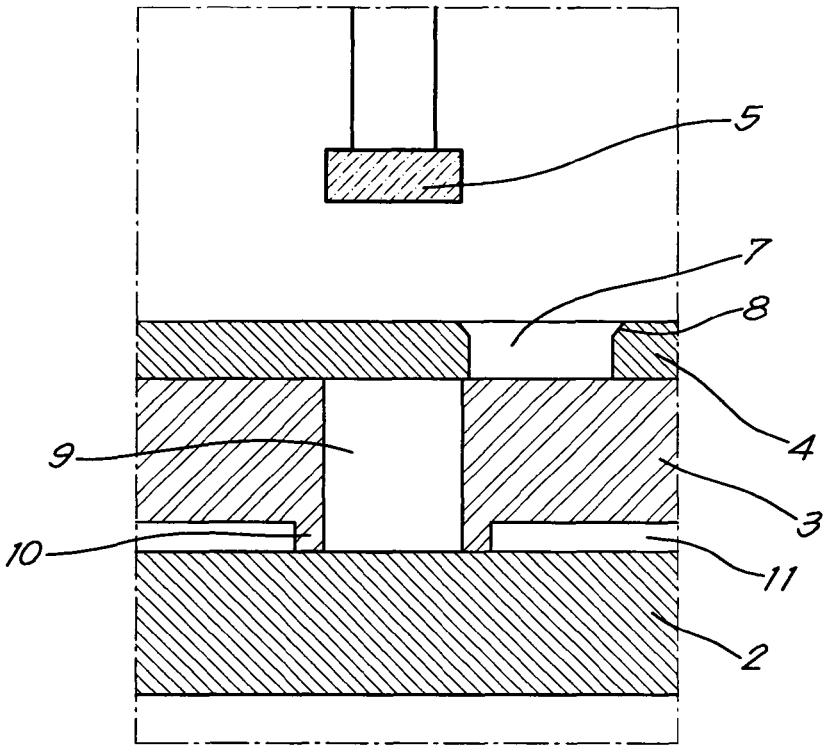
FIG. 2 on a larger scale shows a cross-section according to II-II.

The upper plate 4 and the moulding plate 3 are installed to move vertically together and in FIGS. 1 and 2 are shown in their lowest setting.

The drives and supports to make these movements possible are not shown in the figures because they are well known to a person skilled in the art.

The upper plate 4 has twelve first cavities 7, in this example but not necessarily with a length L of 40 cm and a width B of 5 cm.

At the top the first cavities 7 have a beveled edge 8.

The moulding plate 3 is provided with twelve second cavities 9, also with a length L of 40 cm and a width B of 5 cm. These second cavities 9 determine the form of the concrete articles to be produced.

On the bottom of the second cavities 9 the moulding plate is provided with upstanding edges 10, such that recesses 11 are formed between the second cavities 9 on the bottom of the moulding plate 3.

In the situation shown in FIGS. 1 and 2 the stamps 5 are above the second cavities 9. The first cavities 5 have moved in relation to the second cavities 9, such that parts of the moulding plate 3 between the second cavities 9 close the bottom of the first cavities 7.

The operation of the device 1 is simple and as follows. This is explained using FIGS. 2 to 8.

Figure 3:
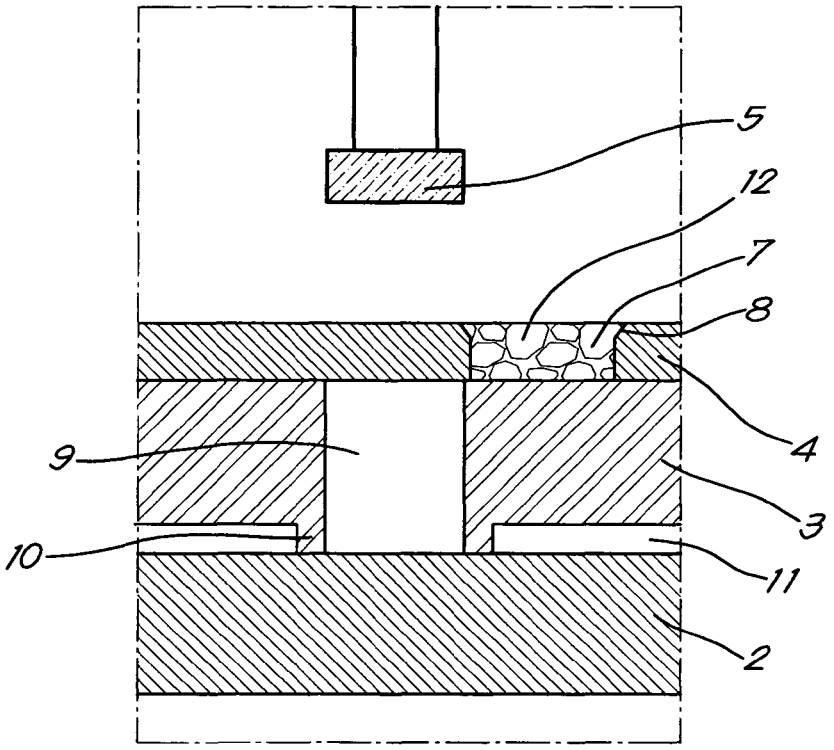
FIGS. 3 to 8 show consecutive states during the use of the device of FIG. 1 in the same cross-section as FIG. 2.

At the start, the device 1 is as shown in FIG. 2. In a first step the first cavities 7 are filled to the top with a non-hardened concrete composition 12. Thanks to the underlying moulding plate 3 this concrete composition 12 cannot go anywhere. This is shown in FIG. 3.

Figure 4:
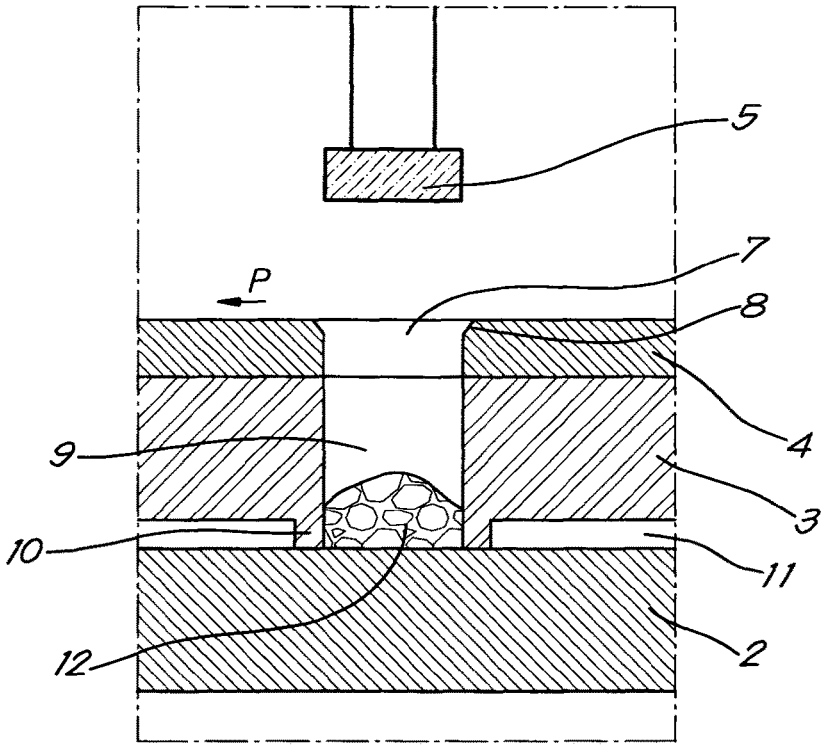

In a second step the upper plate 4 is moved horizontally, as indicated with arrow P, until the first cavities 7 are exactly above the second cavities 9. The concrete composition 12 of the first cavities 7 hereby falls in the second cavities 9. This is shown in FIG. 4.

In a third step the stamps 5 are moved down with force, as indicated by arrow Q and the stamps 5 press the concrete composition 12. Hereby, as is usual when pressing concrete articles, vibration is applied to enhance the compactness of the concrete composition 12.

Hereby, the beveled edges 8 of the first cavities 7 guide the stamps 5.

Figure 5:
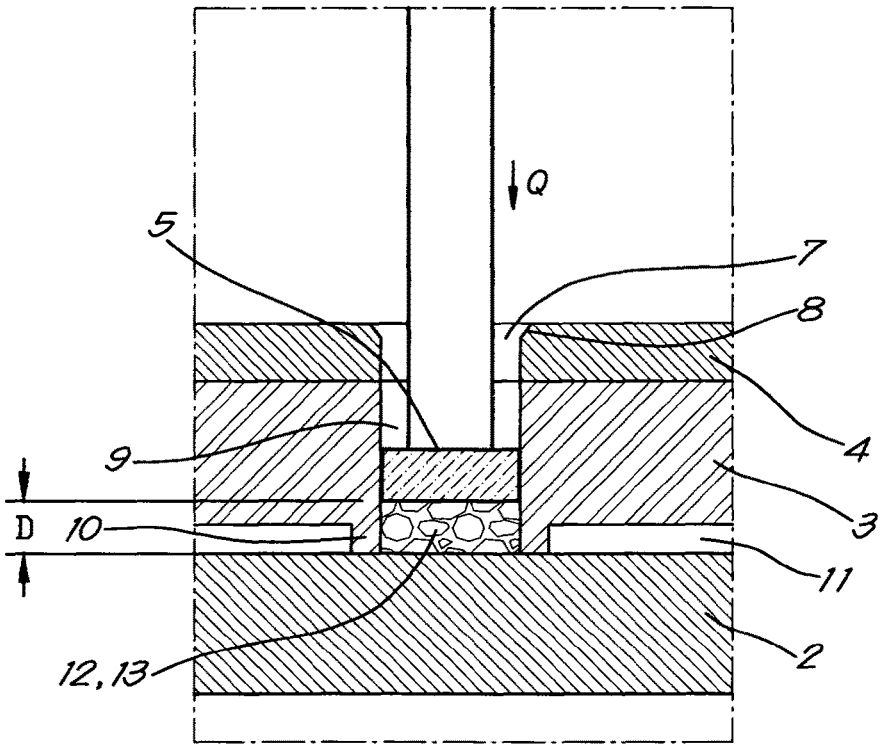

A pressed non-hardened concrete article 13 has now been formed, in this example a strip with a thickness D of 2 cm. This is shown in FIG. 5.

In a next step the moulding plate 3 and the upper plate 4 are lifted, as indicated by arrow R, while the stamps 5 do not move with them.

In an alternative embodiment, to remove the final articles 13 from the moulding plate, the moulding plate 3 and the upper plate 4 are not lifted (and remain in position) but the bottom plate 2 is lowered. A combination of both movements, an upwards movement of the moulding and upper plate and a downwards movement of the bottom plate, is also within the scope of the invention.

Figure 6:
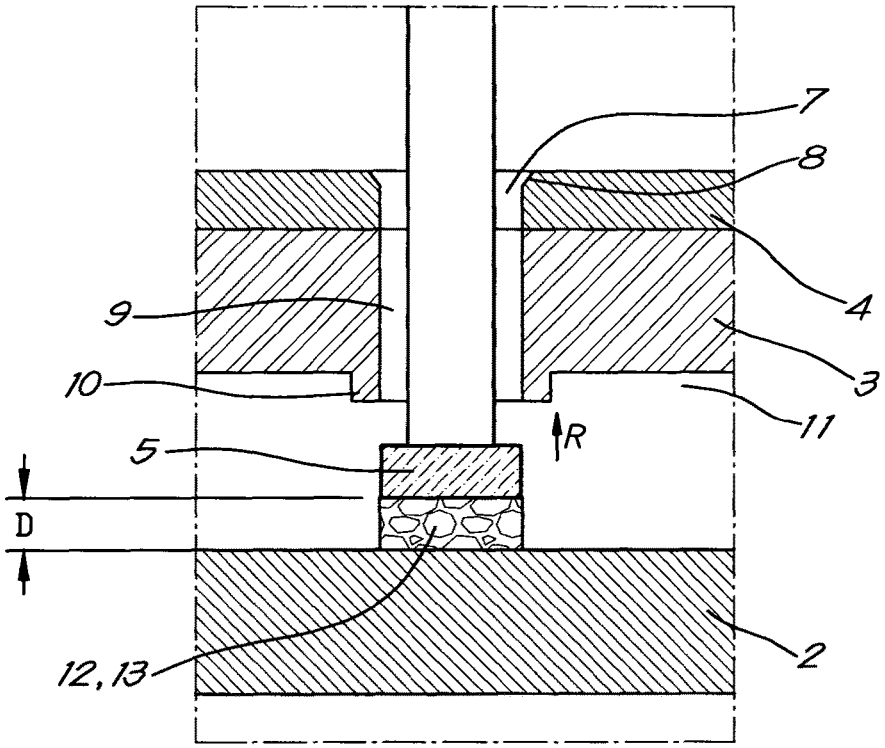

The consequence of this is that the non-hardened concrete articles 13 are removed from the second cavities 9. This state, with the moulding plate 3 and the upper plate 4 in their highest setting, is shown in FIG. 6.

Figure 7:
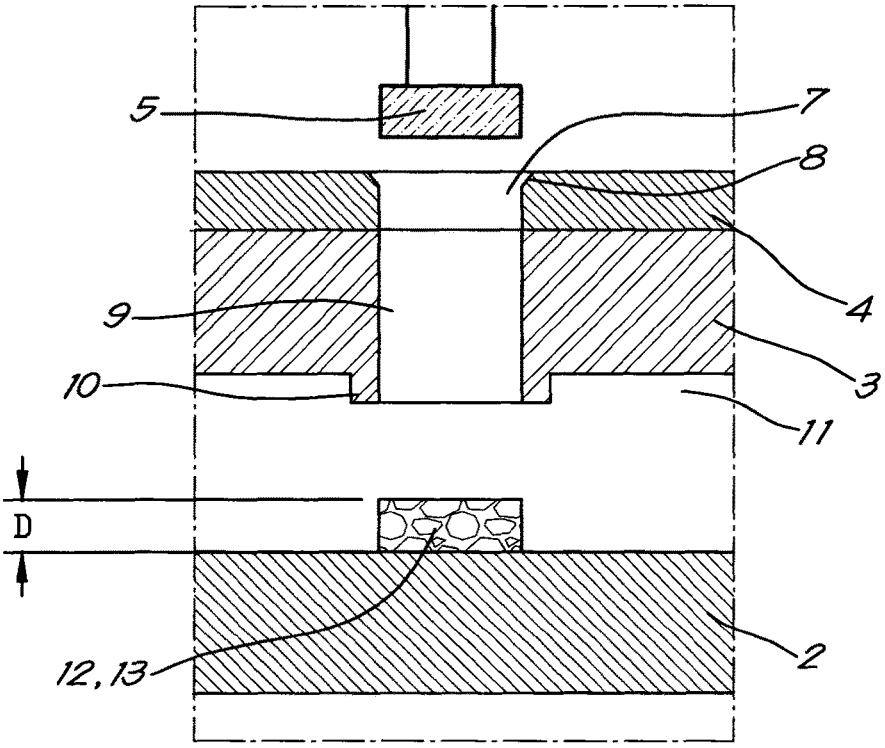

The stamps 5 are then moved up again. Now the non-hardened concrete articles 13 are free on the bottom plate 2. This is shown in FIG. 7.

The whole bottom plate 2 is now removed, such that the non-hardened concrete articles 13 can harden elsewhere and a new bottom plate 2 is placed.

The upper plate 4 is also moved back horizontally to its original position in relation to the moulding plate 3.

Figure 8:
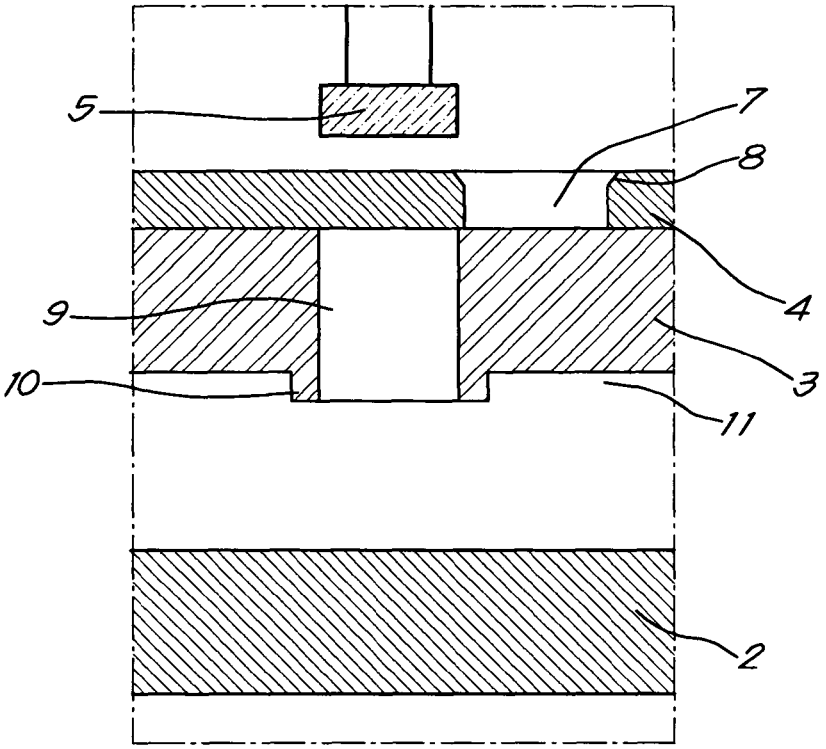

This is shown in FIG. 8.

Then the moulding plate 3 and the bottom plate 4 are put back in their bottom position, such that the device returns to the starting situation of FIG. 2.

The present invention is by no means limited to the embodiment described as an example and shown in the figures, but a device and method according to the invention can be realised in all kinds of forms and dimensions without departing from the scope of the invention.

The invention claimed is:

1. A device (1) for pressing a non-hardened concrete composition (12) into a desired form, comprising:

an upper plate (4) with one or more first cavities (7) that run through the upper plate (4);

a moulding plate (3) with one or more second cavities (9), the upper plate (4) located directly above the moulding plate (3);

a bottom plate (2) located under the moulding plate (3); and one or more stamps (5) located above the one or more second cavities (9), the upper plate (4) and the moulding plate (3) configured to move horizontally in relation to each other between a first position, in which the one or more first cavities (7) are directly and exactly above the one or more second cavities (9), and a second position, in which the one or more first cavities (7) are not above the one or more second cavities (9), a thickness of the upper plate (4) and not a thickness of the moulding plate (3) being decisive for a thickness of a final article produced by the device (1), the upper plate (4) and the moulding plate (3) configured to move vertically together between a lowest position, in which the bottom plate (2) closes the one or more second cavities (9) at a bottom of the moulding plate (3), and a highest position, in which the one or more second cavities (9) at the bottom of the moulding plate (3) is open such that non-hardened concrete articles (13) within the one or more second cavities (9) may exit from the one or more second cavities (9), and the one or more stamps (5) configured to move vertically through the upper plate (4) and the moulding plate (3) when the first cavities (7) are exactly above the second cavities (9) in the first position.

2. The device according to claim 1, wherein the upper plate (4) can be moved horizontally and the moulding plate (3) cannot be moved horizontally.

3. The device according to claim 1, wherein the bottom of the moulding plate (3) is provided with upstanding edges (10) around the one or more second cavities (9), the upstanding edges (10) forming a part of a wall of the one or more second cavities (9), and the upstanding edges rest on the bottom plate, such that a remainder of the moulding plate is free of the bottom plate.

4. The device according to claim 1, wherein the bottom of the moulding plate (3) has upstanding edges (10) around the one or more second cavities (9), whereby the upstanding edges (10) form a part of a wall of the one or more second cavities (9), whereby recesses (11) are formed between the second cavities (9) on the bottom of the moulding plate (3).

5. The device according to claim 1, wherein the one or more first cavities (7) are wider at a top thereof than at a bottom thereof, whereby seen from bottom to top there is no step-wise broadening in one or more first cavities (7).

6. The device according to claim 1, wherein a top of the first cavities (7) has a bevelled edge (8) to guide the stamps (5).

7. The device according to claim 1, wherein the bottom plate (2) is configured to move upwards toward the bottom of the moulding plate (3) and to move downwards away from the bottom of the moulding plate (3).

8. The device according to claim 7, wherein the non-hardened concrete articles (13) are released from the device via a combination of an upwards movement of the upper plate (4) and the moulding plate (3) toward the highest position, and a movement of the bottom plate (2) away from the bottom of the moulding plate (3).

9. A method to manufacture one or more concrete articles (13), comprising:

a first step of putting a non-hardened concrete composition (12) into one or more first cavities (7), whereby the one or more first cavities are applied in an upper plate (4) and whereby the one or more first cavities (7) on the bottom are closed by a moulding plate (3), whereby a thickness of the upper plate (4) and not a thickness of the moulding plate (3) is decisive for a thickness of a final article (13);

a second step of moving the upper plate (4) and the moulding plate (3) horizontally in relation to each other until the one or more first cavities (7) are exactly above one or more second cavities (9) in the moulding plate (3) such that the non-hardened concrete composition (12) falls into the one or more second cavities, whereby a bottom plate (2) located under the moulding plate (3) closes the one or more second cavities (9) on the bottom; and a third step of pressing the non-hardened concrete composition into the one or more second cavities (9) by one or more vertically movable stamps (5) located above the second cavities (9), wherein after the third step the pressed non-hardened concrete composition (12) is removed from the one or more second cavities (9), by either moving the upper plate (4) and the moulding plate (3) upwards or moving the bottom plate (2) downwards, or a combination of an upwards movement of the moulding plate (3) and the upper plate (4) and a downwards movement of the bottom plate (2).

10. The method according to claim 9, wherein in the first step the first cavities (7) are filled to the top with a non-hardened concrete composition (12).

11. The method according to claim 9, wherein the upper plate (4) and the moulding plate (3) are lifted while the stamps (5) do not move.

12. The method according to claim 9, wherein the bottom plate (2) is lowered to remove the pressed non-hardened concrete composition (12) from the one or more second cavities (9).

13. The method according to claim 9, wherein the method allows thin concrete articles to be manufactured by means of pressing.

14. The method according to claim 9, wherein the bottom plate (2) with the pressed articles (12) is removed from under the moulding plate (3) and replaced by another bottom plate (2), or whereby the bottom plate (2) moves horizontally as a continuous support when removing the pressed articles (12).

15. The method of claim 14, wherein the continuous support is an assembly line.

16. The method according to claim 9, wherein the bottom plate (2) is lowered to remove the pressed non-hardened concrete composition (12) from the one or more second cavities (9) whereby the stamps (5) move downwards to push the concrete articles (12) through the second cavities (9).

* * * * *